US011993944B2

(12) United States Patent
Culley

(10) Patent No.: US 11,993,944 B2
(45) Date of Patent: May 28, 2024

(54) SWING ARRANGEMENT FOR A POLE

(71) Applicant: Troy Reece Culley, New South Wales (AU)

(72) Inventor: Troy Reece Culley, New South Wales (AU)

( * ) Notice: Subject to any disclaimer, the term of this patent is extended or adjusted under 35 U.S.C. 154(b) by 274 days.

(21) Appl. No.: 17/500,256

(22) PCT Filed: Apr. 16, 2020

(86) PCT No.: PCT/AU2020/050379

§ 371 (c)(1),
(2) Date: Oct. 13, 2021

(87) PCT Pub. No.: WO2020/210873

PCT Pub. Date: Oct. 22, 2020

(65) Prior Publication Data

US 2023/0175281 A1 Jun. 8, 2023

(30) Foreign Application Priority Data

Apr. 17, 2019 (AU) ..... 2019901326
Oct. 16, 2019 (AU) ..... 2019903906

(51) Int. Cl.
*E04H 12/18* (2006.01)
*E04H 12/22* (2006.01)
*E04H 12/00* (2006.01)

(52) U.S. Cl.
CPC ..... *E04H 12/18* (2013.01); *E04H 12/2284* (2013.01); *E04H 12/00* (2013.01); *E04H 12/22* (2013.01)

(58) Field of Classification Search
CPC ..... E04H 12/18; E04H 12/22; E04H 12/20; E04H 12/00; E04H 12/02; E04H 12/2284; E04H 12/182; E04H 12/185; F16L 27/00
USPC ..... 248/521, 122.1, 289.1; 285/184, 181, 285/412, 414, 907
See application file for complete search history.

(56) References Cited

U.S. PATENT DOCUMENTS 5,437,482 A * 8/1995 Curtis ..... F16L 23/18 285/368
6,050,614 A * 4/2000 Kirkpatrick ..... F16L 23/0283 285/368
6,957,832 B1 * 10/2005 Pannekoek ..... F21S 8/081 285/414

(Continued)

FOREIGN PATENT DOCUMENTS

| | | |
|---|---|---|
| CN | 104696840 | 6/2015 |
| GB | 2534953 | 8/2016 |
| KR | 101314649 | 10/2013 |

OTHER PUBLICATIONS

International Search Report filed in PCT/AU2020/050379 dated May 28, 2020.

*Primary Examiner* — Nkeisha Smith
(74) *Attorney, Agent, or Firm* — Rankin, Hill & Clark LLP

(57) ABSTRACT

Examples of a swing arrangement for a pole include a first part connectable to a first section of the pole, a second part connectable to a second section of the pole and a friction reducing housing arranged to rotatably house and couple the second part to the first part in a coupled condition so as to provide a rotational axis about which the first and second sections of the pole pivot. A pole including the swing arrangement and a related method are also disclosed.

16 Claims, 9 Drawing Sheets

(56) References Cited

U.S. PATENT DOCUMENTS

| | | | | |
|---|---|---|---|---|
| 7,140,685 | B2 * | 11/2006 | Gardner | F16C 19/364<br>297/344.21 |
| 7,604,217 | B2 * | 10/2009 | Lum | F16L 29/002<br>251/153 |
| 10,287,990 | B2 * | 5/2019 | Winkler | F01D 11/005 |
| 10,392,826 | B2 * | 8/2019 | Pannekoek | F21V 21/36 |
| 11,172,665 | B2 * | 11/2021 | McQuade | A01K 97/10 |
| 2016/0145888 | A1 * | 5/2016 | Townsend, Jr. | E04H 12/18<br>248/560 |
| 2016/0312488 | A1 * | 10/2016 | Pannekoek | E04H 12/32 |

* cited by examiner

SWING ARRANGEMENT FOR A POLE

RELATED APPLICATIONS

This application claims priority from Australian provisional patent applications nos. 2019901326 & 2019903906 both entitled "Swing Arrangement for a Pole" filed on 17 Apr. 2019 & 16 Oct. 2019, respectively, the contents of which are incorporated by reference.

TECHNICAL FIELD

The invention relates to a swing arrangement for a pole or similar elongate structure. More specifically, the invention relates to a swing arrangement fitted to a pole that allows the selective lowering and elevation of an article supported by the pole.

BACKGROUND

Elongate structures such as a pole are often used to support articles signs, lights, speakers or the like. Such poles may be relatively tall and need to be lowered and raised by a person to reach the articles such as for maintenance. Accordingly, various swinging or pivoting means to elevate and lower poles have been developed.

Once such swinging means includes a pivoting arrangement fitted intermediate a length of a pole that allows a top section of the pole to pivot about a pivot axis that is 45 degrees relative to a vertical axis of a lower section of the pole. Accordingly, as the top section moves about the pivot axis an article carried by the top section is relatively lowered toward the ground.

Other swinging means include use of a pivoting arrangement that has a horizontal axis arranged between an upper and a lower section of the pole to allow relative lowering and raising of a top section of the pole.

A problem with such swing arrangements relates to ease of use as, for example, tools may be required to release the swing arrangements. Further problems relate to safety as, for example, the swing arrangements may unexpectedly move once released, this can be particularly problematic with a horizontal axis pivoting arrangement because the top section of the pole may swing directly downwardly.

The invention disclosed herein seeks to overcome one or more of the above identified problems or at least provide a useful alternative.

SUMMARY

In accordance with a first broad aspect there is provided, a swing arrangement for a pole, the swing arrangement including a first part connectable to a first section of the pole, a second part connectable to a second section of the pole and a friction reducing housing arranged to rotatably house and couple the second part to the first part in a coupled condition so as to provide a rotational axis about which the first and second sections of the pole pivot.

In an aspect, the housing includes an aperture shaped to receive and retain the second part therein in the coupled condition.

In another aspect, the housing includes a retainer shaped to capture the second part within the aperture in the coupled condition.

In yet another aspect, the retainer is a ledge at least partially blinding the aperture.

In yet another aspect, the housing includes a recess defined between a face of the housing and the ledge, and wherein the depth of the recess is substantially equal to a thickness of the second part.

In yet another aspect, the recess is shaped to snugly fit with the second part.

In yet another aspect, the housing is formed of or includes a friction reducing plastic.

In yet another aspect, the swing arrangement includes a hand operable locking part adapted to allow selective movement of the first and second parts in an unlocked state, and substantially immobilise movement of the first and second parts in a locked state.

In yet another aspect, the hand operable locking part is biased toward the locked state.

In yet another aspect, wherein the hand operable locking part includes a pin.

In yet another aspect, the housing is arranged such that friction is able to be applied to the second part at least partially retarding rotation thereof.

In yet another aspect, the swing arrangement includes a third part adapted to be coupled to the first part with the housing and the second part is captured between the first part and the third part.

In yet another aspect, the housing is adapted to provide a spacer between the first part and the third part.

In yet another aspect, the first part is a first plate, the second part is a second plate and the third part is a third plate, the first plate and the third plate being adapted to be secured together in the coupled condition with the second plate and the housing therebetween.

In yet another aspect, the first plate, the third plate and the housing are adapted to be secured together such that the second plate is secured at a predetermined friction within the housing.

In yet another aspect, the first plate, the third plate and the housing are adapted to be secured together such that the second plate at held at a friction so as to be hand moveable.

In yet another aspect, the first plate, the third plate and the housing are adapted to be secured together to inhibit relative rotation thereof.

In yet another aspect, the first plate, the third plate and the housing are clamped together by one or more fasteners to inhibit relative rotation therebetween.

In yet another aspect, the second plate is circular and the aperture is also circular so as to allow rotation of the second plate thereof.

In yet another aspect, the swing arrangement includes a hand operable locking part adapted to allow selective movement of the first and second plates in an unlocked state and substantially immobilise movement of the first and second plates in a locked state.

In yet another aspect, the hand operable locking part is biased toward the locked state.

In yet another aspect, the hand operable locking part is carried by and accessible from the first plate.

In yet another aspect, the second plate includes at least one aperture to receive the pin in the locked state.

In yet another aspect, the housing is formed of or includes a friction reducing plastic.

In yet another aspect, the rotational axis is at an acute angle relative to the first section of the pole.

In yet another aspect, the rotational axis is at a horizontal angle relative to the first section of the pole.

In accordance with a second broad aspect there is provided, a pole assembly including a swing arrangement as described above and herein.

In accordance with a third broad aspect there is provided, a method of using a swing arrangement between a first section and a second section of a pole, the method including: from an initially locked state, in which a releasable locking part locks a first part connected to the first section relative to a second part connected to the second section against relative rotation, moving the releasable locking part to an unlocked state; in the unlocked state, rotating the first part relative to the second part that is located within a housing that couples the second part to the first part, the rotation being about a rotational axis so as to relatively bring an end of the first section toward an end of the second section in a rotated condition; and releasing the locking part to at least temporarily lock the first and second parts in the rotated condition.

In accordance with a fourth broad aspect there is provided, a method of using a swing arrangement between a first section and a second section of a pole, the method including: from an initially locked state, in which a releasable locking part locks a first part connected to the first section relative to a second part connected to the second section against relative rotation, moving the releasable locking part to an unlocked state; in the unlocked state, rotating the first part relative to the second part that is located within a housing that couples the second part to the first part, the rotation being about a rotational axis so as to relatively bring an end of the first section toward an end of the second section in a rotated condition with a friction applied to the second part at least partially retarding rotation; and releasing the locking part to at least temporarily lock the first and second parts in the rotated condition.

In accordance with a fifth broad aspect there is provided, a swing arrangement for a pole, the swing arrangement including a first plate connectable to a first section of the pole, a second plate connectable to a second section of the pole and a friction reducing housing arranged to rotatably house and couple the second plate to the first plate in a coupled condition in which the swing arrangement has a rotational axis that may be horizontal or at an acute angle relative to the first section of the pole.

In accordance with a sixth broad aspect there is provided, a swing arrangement for a pole, the swing arrangement including a first part connectable to a first section of the pole, a second part connectable to a second section of the pole and a housing arranged to rotatably house and couple the second part to the first part in a coupled condition with a predetermined friction therebetween so as provide constrained rotation about a rotational axis about which the first and second sections of the pole pivot.

In accordance with a seventh broad aspect there is provided, a swing arrangement for a pole, the swing arrangement including: a first part connectable to a first section of the pole, a second part connectable to a second section of the pole, a housing arranged to rotatably house and couple the second part to the first part in a coupled condition, and a hand operable locking part adapted to allow selective movement of the first and second parts in an unlocked state, and substantially immobilise movement of the first and second parts in a locked state, wherein the housing and first part are urged into engagement in the coupled condition so as to have friction therebetween in at least the unlocked state so as to provide friction constrained rotation about a rotational axis about which the first and second sections of the pole pivot.

BRIEF DESCRIPTION OF THE FIGURES

The invention is described, by way of non-limiting example only, by reference to the accompanying figures, in which.

DETAILED DESCRIPTION

First Example

Figure 1:
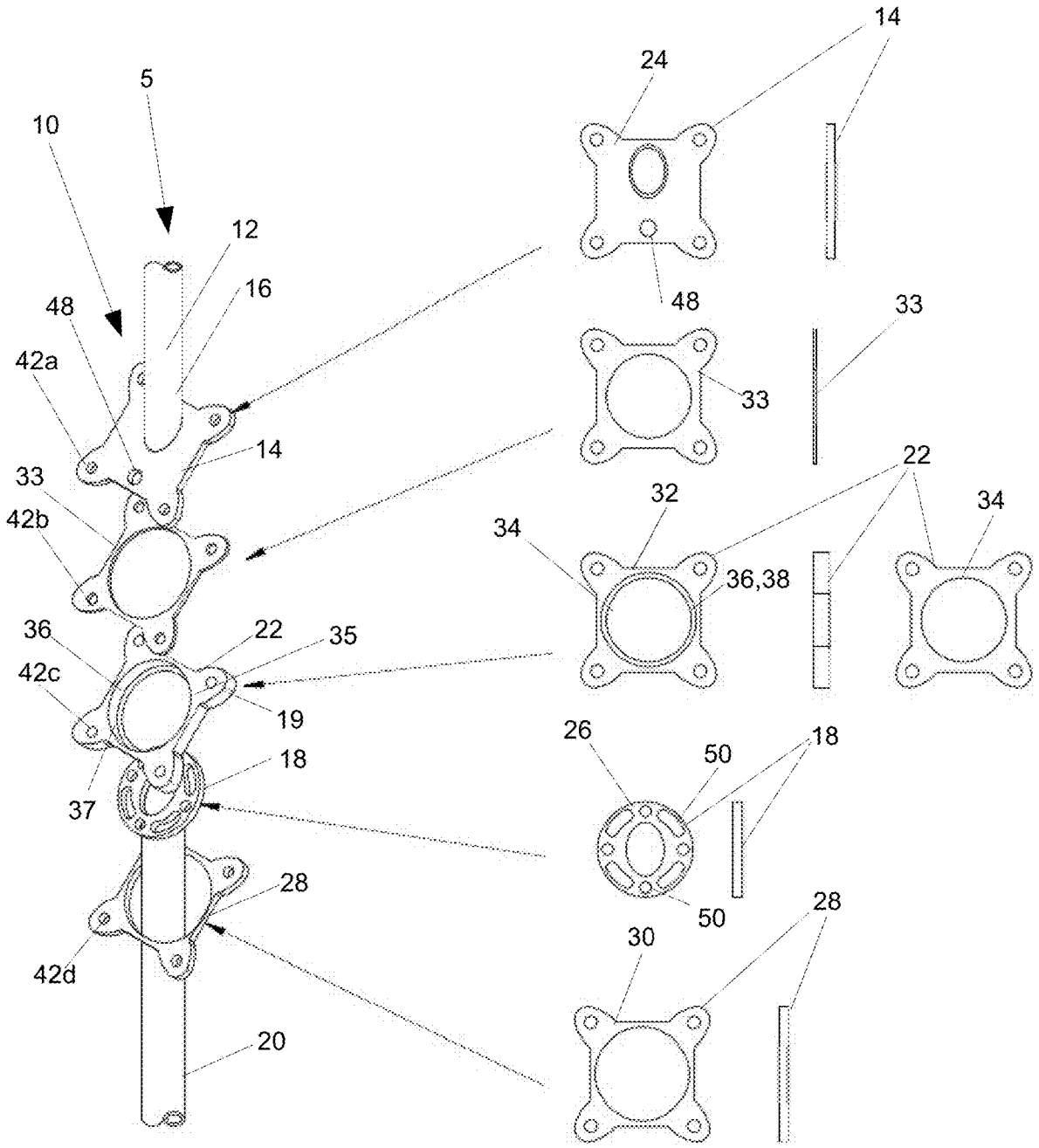
FIG. 1 is an exploded parts perspective view illustrating a first example of a pole assembly fitted with a swing arrangement.
Figure 2:
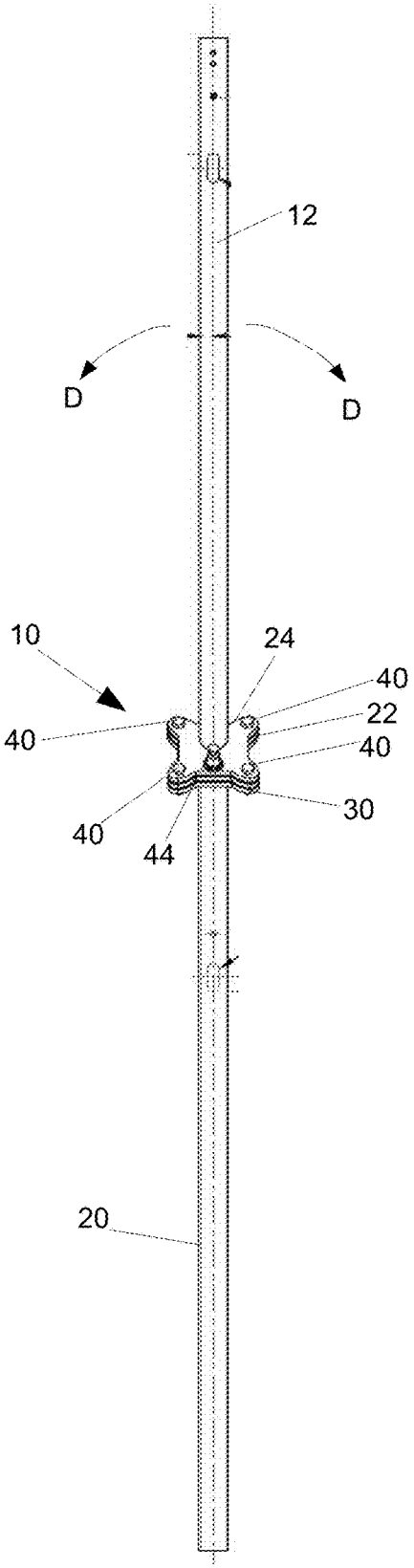
FIG. 2 is a front view illustrating the swing arrangement.
Figure 3:
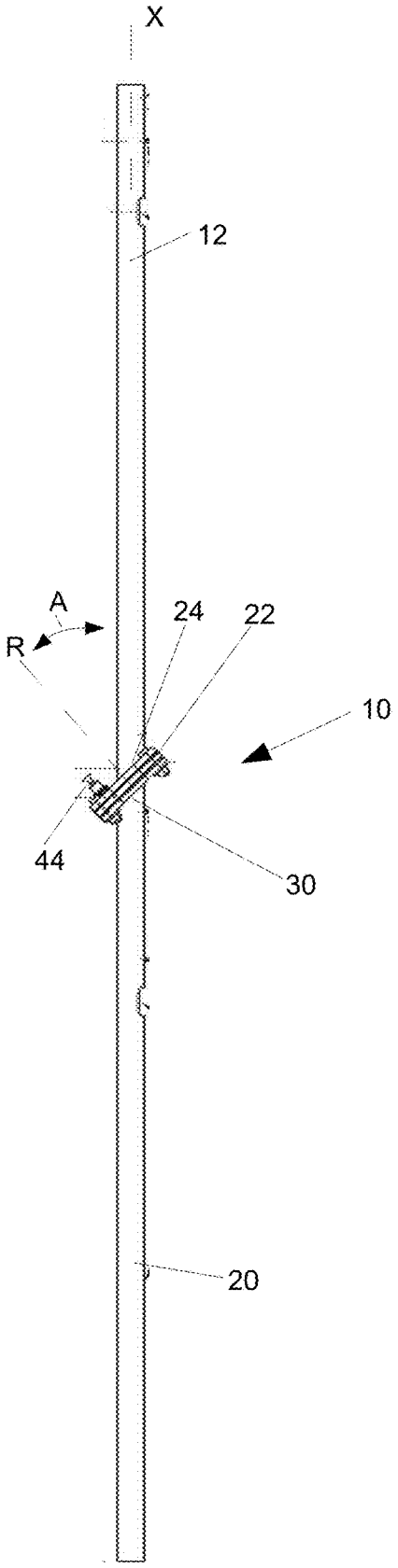
FIG. 3 is a side view illustrating the swing arrangement.
Figure 4:
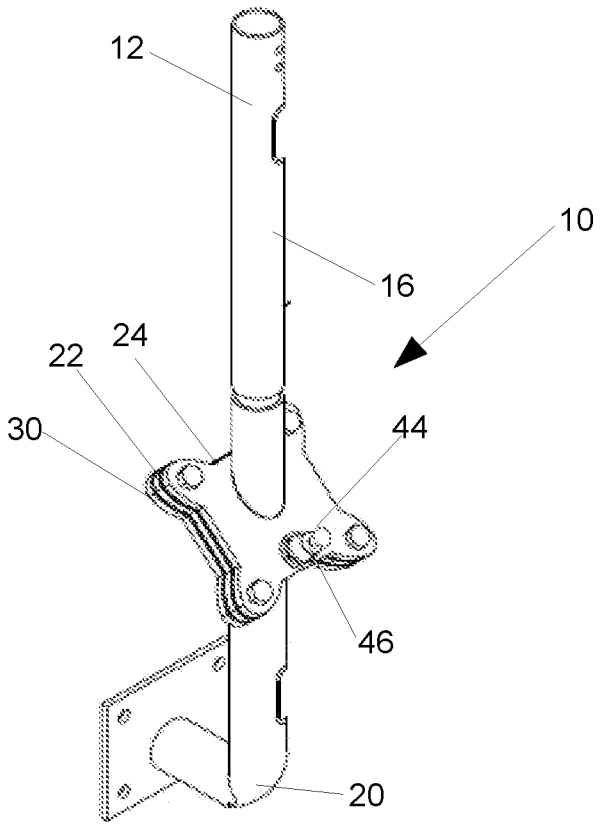
FIG. 4 is a perspective view illustrating the swing arrangement.
Figure 5A:
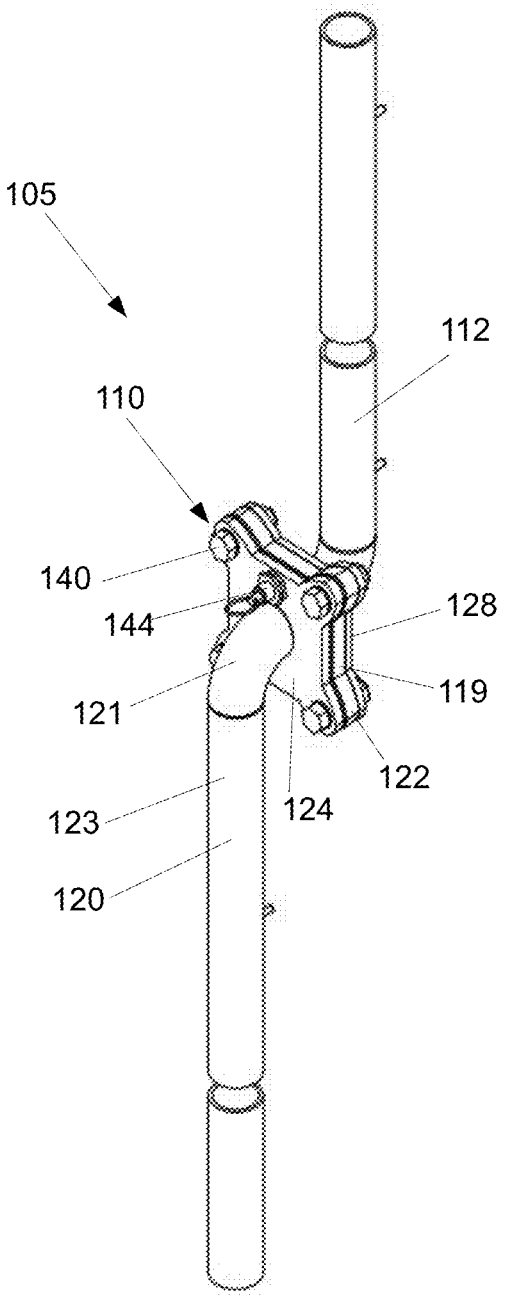
FIG. 5*a* is a front perspective view illustrating a second example of pole assembly with a swing arrangement.
Figure 5B:
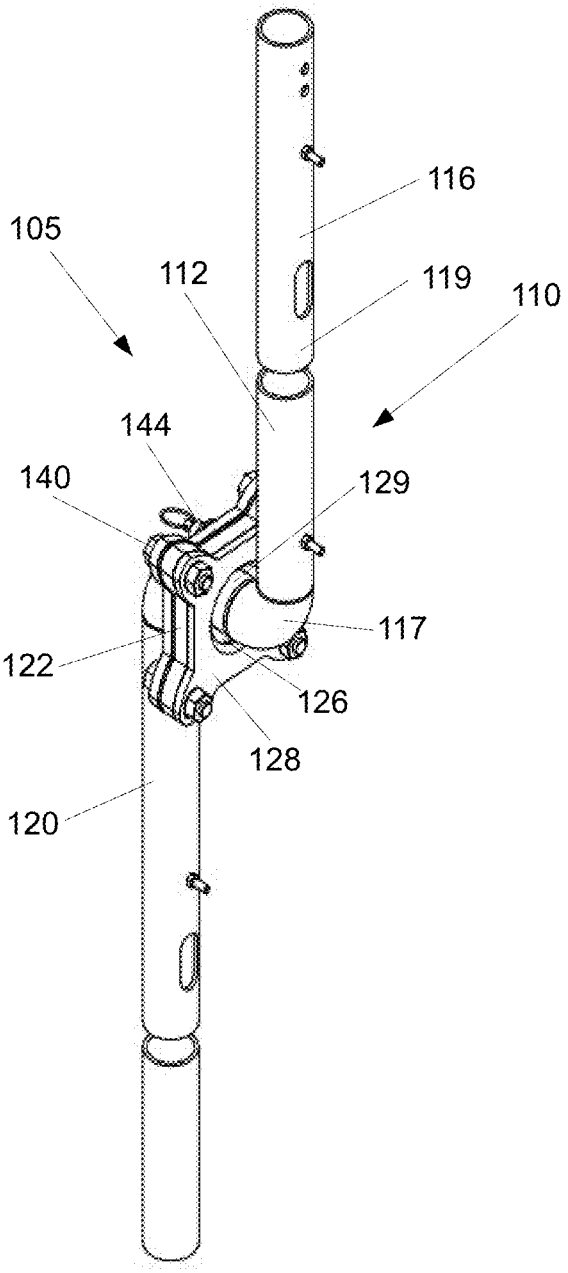
FIG. 5*b* is a further rear perspective view illustrating the second example of the swing arrangement.
Figure 6A:
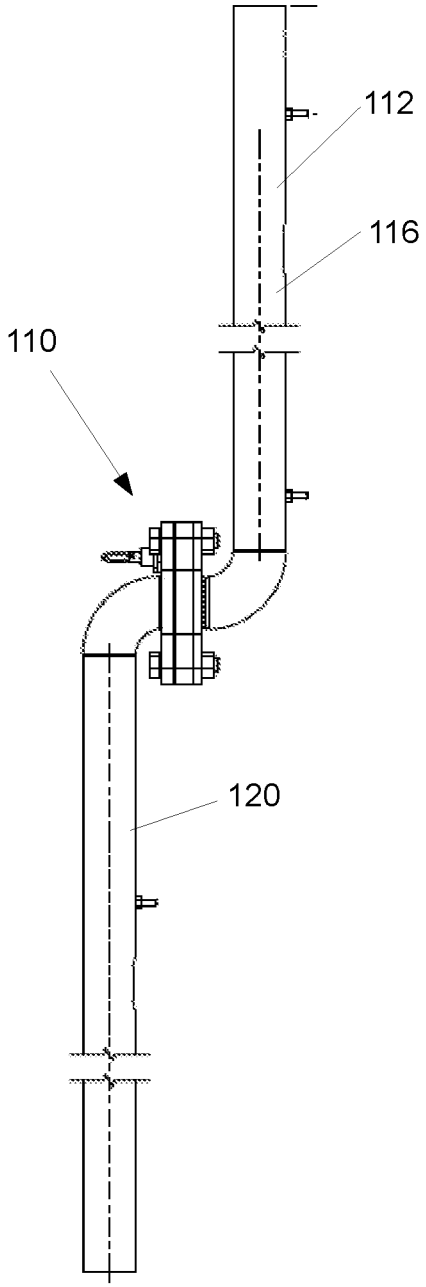
FIG. 6*a* is a side view illustrating the second example of the swing arrangement.
Figure 6B:
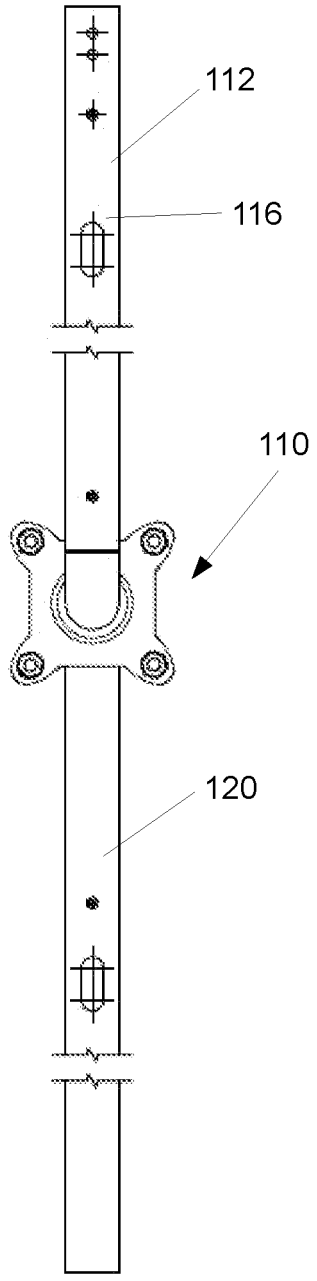
FIG. 6*b* is a rear view illustrating the second example of the swing arrangement.
Figure 16A:
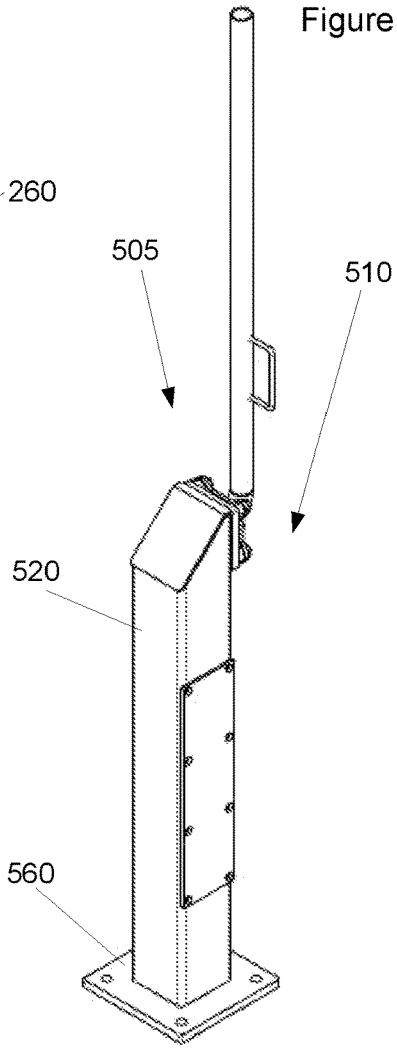
FIGS. 16*a* and 16*b* are rear and front perspective views illustrating a sixth example of the pole assembly and swing arrangement.
Figure 16B:
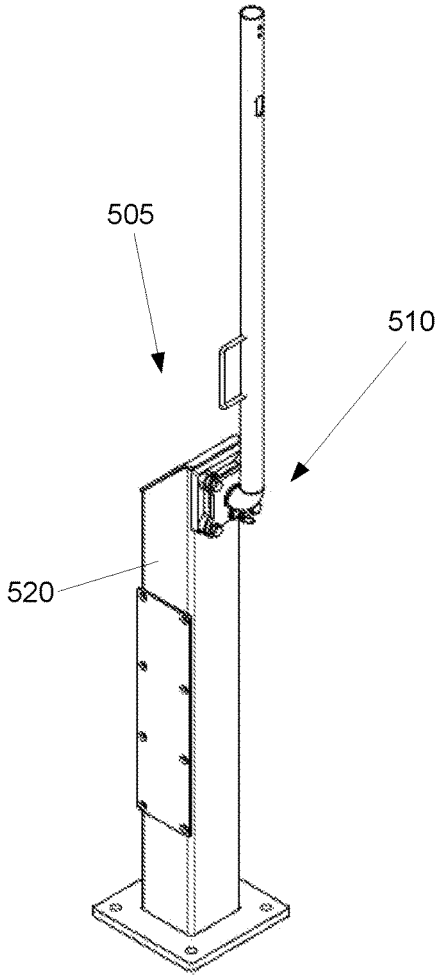
Figure 17A:
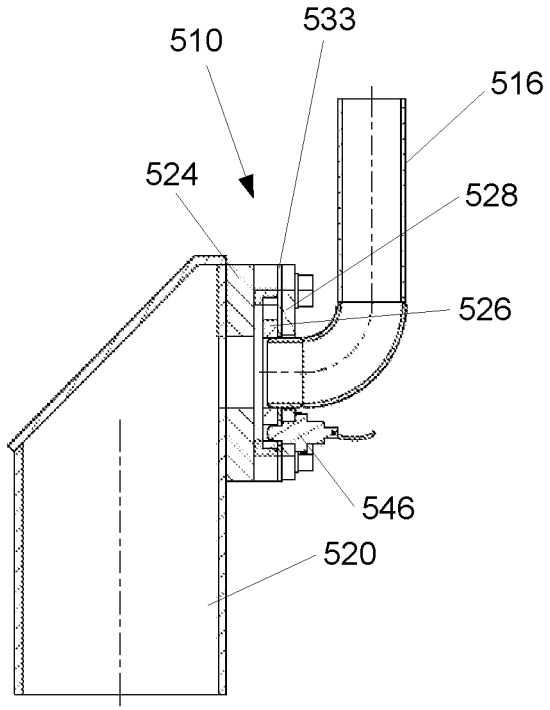
FIGS. 17*a* and 17*b* respectively illustrate a side cross section and a exploded parts perspective view of the sixth example.
Figure 17B:
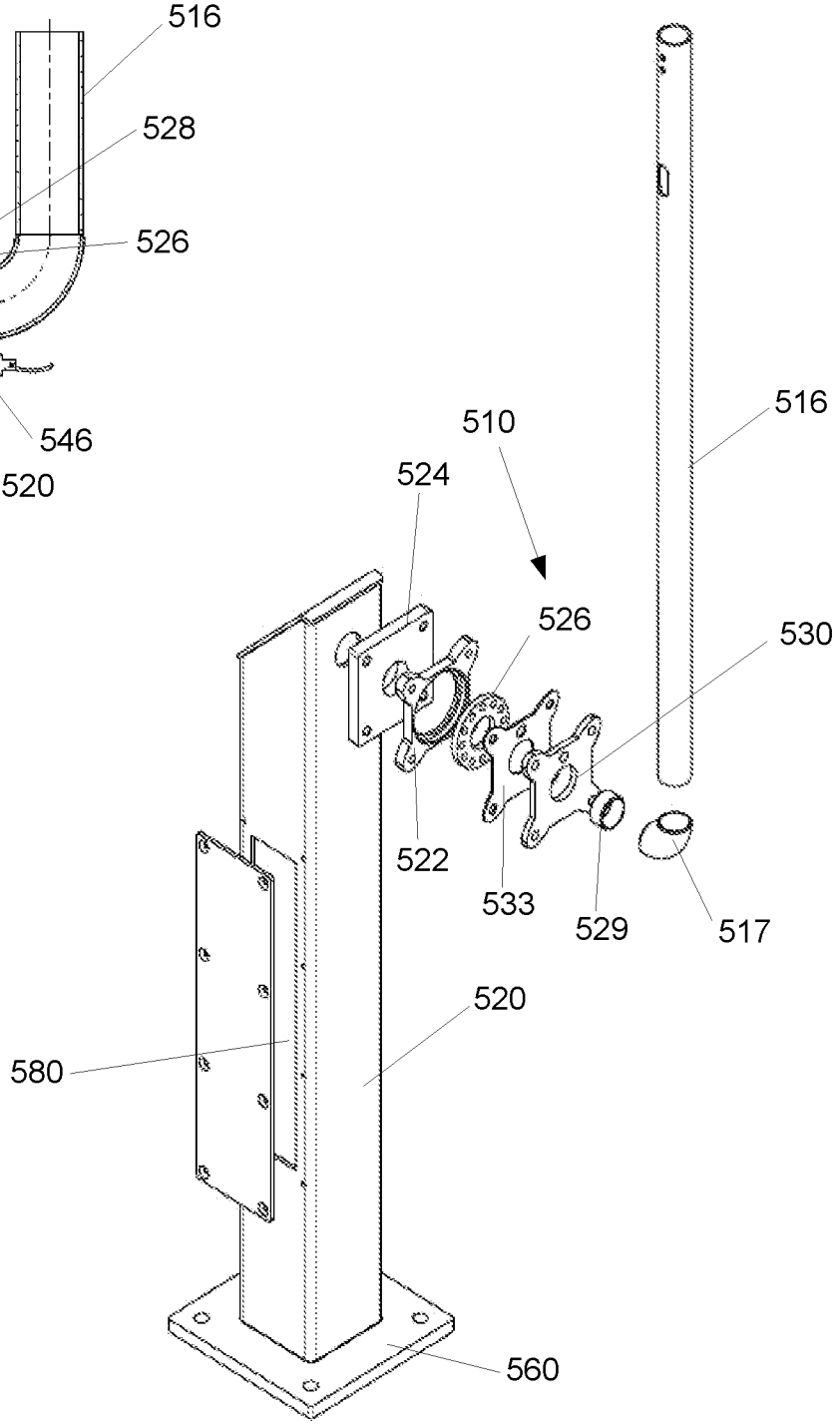

Referring to FIGS. 1 to 4, there is shown a first example of pole assembly 5 including a swing arrangement 10 and a pole 12. The pole 12 may have multiple parts or sections and include in scope any straight or non-straight members such as posts, columns or struts. The pole 12 may be used to support an article (not shown) such as, but not limited to, a light, sign, speaker, flag or the like. FIGS. 5*a* and 16*b* show further examples of the pole assembly and swing arrangement that are further detailed below.

Referring to the first example in FIGS. 1 to 4, in this example, the swing arrangement 10 includes a first part 14 connectable to a first section 16 of the pole 12, a second part 18 connectable to a second section 20 of the pole and a friction reducing part 19 in the form of a housing 22 arranged to rotatably retain or house the second part 18, and couple the second part 18 to the first part 14 in a coupled condition so as to provide a rotational axis "R" that is at an acute angle "A" relative to an elongate axis "X" the pole 12.

The first section 16 may be, but not limited to, an upper most section of the pole 12 and the second section 20 may be, but not limited to, a lower most section or base. The arrangement may, or course, be reversed. The acute angle may be in the range of about 1 to 89 degrees, and preferably about 30 to 60 degrees, and most preferably close to about 45 degrees. It is noted that in the further example below shown in FIGS. 5*a* to 16*b*, the rotational axis "R" may be a horizontal axis "H" relative to the elongate axis of the first section 16 of the pole 12.

More specifically, in this example, the first part 14 is a first plate 24, the second part 18 is a second plate 26 and there is also a third part 28 in the form of a third plate 30. The first plate 24 and the third plate 30 provide respective upper and lower friction plates. The housing 22 being captured between the first plate 24 and the third plate 30. However, it is noted that in some examples the housing 22 could be coupled to the first part 14 without the third plate 30. In this example, a wear plate 33 is located between the housing 22 and the first plate 24. The wear plate 33 provides a bearing surface against with the second plate 26 may bear. It is noted that in some examples, the wear plate 33 may form part of the housing 22. Accordingly, friction applied by the housing 22 and/or wear plate 33 are able provide controlled resistance to retard free rotation of the second plate 26.

The first plate 24 is generally flat and is angled at an acute angle "A" of about 45 degrees relative to the elongate axis "X" the pole 12. However, other suitable acute angles may be used. The first plate 26 may be formed of a metal or other suitable material.

The housing 22 provides a spacer 32 between the first plate 24 and the third plate 30 and includes an aperture 34 with a recess 37 shaped to receive the second plate 26 and retain the second plate 26 therein in the coupled condition. The housing 22, more specifically the recess 37, fittingly encapsulates the second plate 26. The housing 22 and wear plate 33 may be formed of a low friction material such as a plastic, more specifically Teflon or Nylon, that allows sliding frictional movement of the second plate 26 therein that may be formed from a metal.

The second plate 26 is generally flat and circular and is received within the recess 37 in the coupled condition. The second plate 26 may be formed of a metal or other suitable material. The second plate 26 is also arranged at an acute angle of about 45 degrees relative to the elongate axis "X" the pole 12. However, again, other suitable acute angles may be used.

The second plate 26 may rotate within the recess 37. The housing 22, more specially the recess 37 includes a retainer 36 in the form of a lip or annular ledge 38 that extends partly across the aperture 34 to capture the second plate 26 within the housing 22 when secured to the first plate 24. In this arrangement, the second plate 26 is substantially encapsulated by the housing 22 and retained toward the first plate 26.

The depth of the recess 37, between a face 35 of the housing 22 and the lip 38, may be about the same or slightly greater than a thickness of the second plate 26 so that the second plate 26 may be snuggly received, with some friction between the second plate 26, the wear plate 33 and the first plate 24.

The third plate 30 is similarly shaped to the first plate 24 and is secured thereto fasteners 40 by corresponding apertures 42*a*, 42*b*, 42*c* and 42*d* of each of the first plate 24, the wear plate 33, the housing 22 and the third plate 30, respectively. The third plate 30 may be formed of a metal. As above noted, the third plate 30 is a lower friction plate and the first plate 24 is an upper friction plate that clamp together to couple the assembly.

In more detail, the fasteners 40 may be bolts with corresponding nuts that are used to compress the first plate 24 and third plate 30 together, whist allowing the second plate 26 to remain free or under relatively light friction within the aperture 34 of the housing 22. It is noted that the fasteners 40 do not need to be released to move the first plate 24 relative to the second plate 26.

To releasably lock movement of the first plate 24 and the second plate 26, and the respective first and second sections 16, 20 of the pole 12, the swing arrangement 10 includes a hand operable locking part 44 adapted to allow selective movement of the first and second plates 24, 26 in an unlocked state and substantially immobilise movement the first and second plates 24, 26 in a locked state.

In this example, the locking part 44 adapted includes a pin 46 that is carried by a pin aperture 48 of the first plate 24. The second plate 26 includes several receiving apertures 50, include some round and some circumferential slots, in which the pin 46 is received to lock the rotation of the first plate 24 and the second plate 26 in the locked state.

In this example, the pin 46 is biased using a spring (not shown) into the locked state thereby providing a safety advantage whereby, for example, if the pin 46 is moved to disengage with the apertures 50 of second plate 26 and then released—the pin 46 will move to automatically return to the locked state thereby, for example, keeping the first section 16 of the pole 12 from falling. The pin 46, may of course, be released as need be to lock the first section 16 at any desired height, lowered or raised, relative to the second section 20.

In this arrangement, it is to be appreciated that the first plate 24, the wear plate 33, the housing 22 and the third plate 30 remain coupled and are not required to be released or loosened to allow rotational movement of the second plate 26 within the housing 22. The only the pin 46 is required to be actuated, such as being pull by hand, to be disengaged from the second plate 26 and allow the second plate 26 to move relative the first plate 23. The low friction material and spacing provided by the housing 22 allowing the second plate 26 to remain snuggly fitted—but still able to rotate in the unlocked state.

Accordingly, a method of use is both simple and safe, and does not require tools. A user is simply required to actuate the pin 46, such as by pulling the pin 46. In the unlocked state, the first section 16 of the post 12 carried by the first plate 24 is then rotatable relative to the second plate 26 carried by the second section 20 of the post 12 about the axis "R". The first section 16 of the post 12 and any article carried thereby is then relatively lowered and the pin 46 may be released to the locked state to secure the first section 16 in the lowered condition toward the second section 20. The article may then be accessed as need be. The pin 46 may again then be actuated to the unlock state and the first section 16 of the post 12 elevated back to the vertical and the pin 46 may then be again released to the locked state.

It is noted that whist the swing arrangement has been described with reference to use with a pole, the swing arrangement may find use other with other forms of structures and it not limited to use only with a pole.

Further Examples

Referring now to FIGS. 5*a* to 17*b*, there are shown further examples of the pole assembly including the swing arrangement in which like sequences of numerals are used to denote like parts (i.e 10, 110, 210 etc).

In these examples, the overall configuration of the swing arrangement 110 is similar to that of the first example, however, the swing arrangement 110 is adapted to pivot about a generally horizontal rotational axis "H" that is generally perpendicular to the first section 116 of the pole 112. Accordingly, all parts are not again described in detail herein, with the focus here being on the general configuration of the swing arrangement 110 and any adaptations to improve functionality of the horizontal arrangement.

Figure 7A:
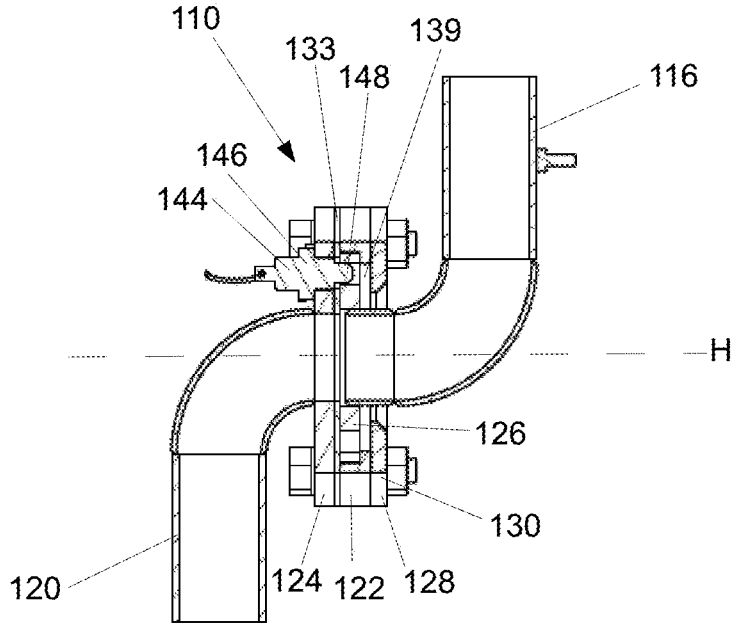
FIG. 7*a* is a side cross sectional side view illustrating the second example of the swing arrangement
Figure 7B:
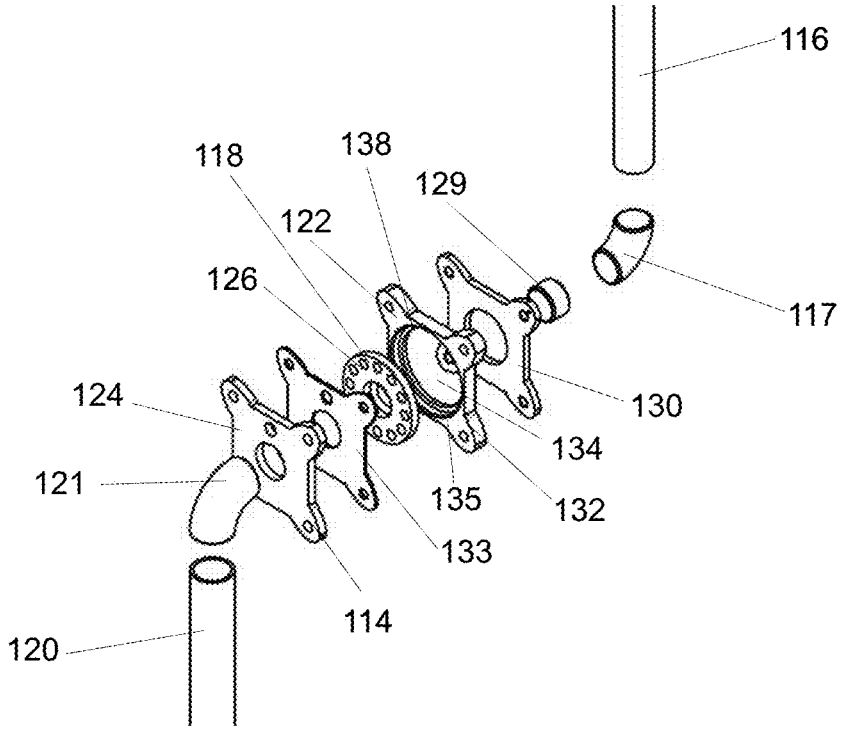
FIG. 7*b* is an exploded parts view illustrating the second example of the swing arrangement.
Figure 8A:
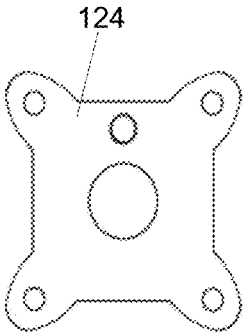
FIGS. 8*a* and 8*b* are front and side views illustrating a first plate of the swing arrangement.
Figure 8B:
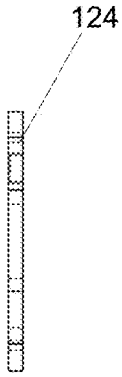
Figure 9A:
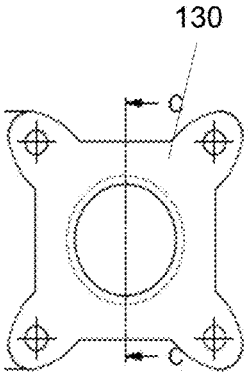
FIGS. 9*a* and 9*b* are front and side views illustrating a third plate of the swing arrangement.
Figure 9B:
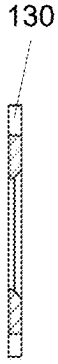
Figure 10A:
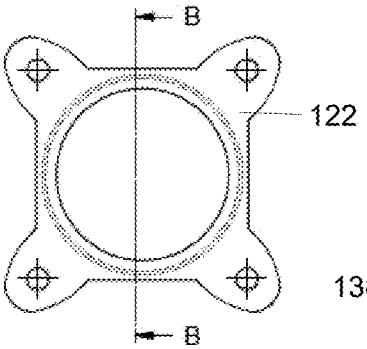
FIGS. 10*a* and 10*b* are front and side views illustrating a housing of the swing arrangement.
Figure 10B:
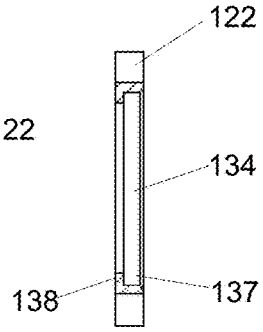
Figure 11A:
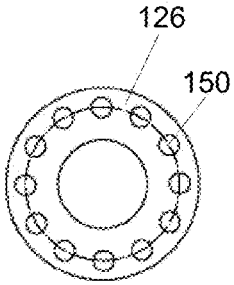
FIGS. 11*a* and 11*b* are front and side views illustrating the second plate of the swing arrangement.
Figure 11B:
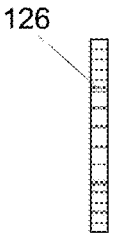
Figure 12A:
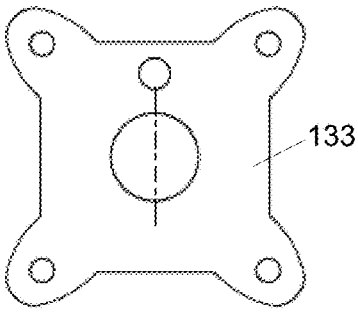
FIGS. 12*a* and 12*b* are front and side views illustrating a wear plate of the second plate of the swing arrangement.
Figure 12B:
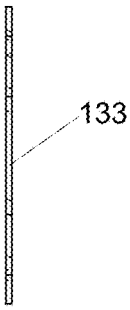

Turning now to FIGS. 5*a* to 12*b*, in this example, the swing arrangement 110 includes a second part 118, in the form of a second fixed round plate 126, connectable to a first or upper section 116 of the pole 12, a first part 114, in the form of a first fixed plate 124, connectable to the second or lower section 120 of the pole 112, and a friction reducing part 119 in the form of a housing 122 arranged to rotatably retain or house the second part 118 in the form of the second fixed round plate 126 so as to allow rotation about a generally horizontal axis "H", shown in FIG. 7*a*.

A third part 128 in the form of a third plate 130 is also provided that in this example is arranged closest to the first section 116 of the pole 112. Like the first example, the third plate 130 is secured by fasteners 140 to the first fixed 124 plate with the second fixed round plate 126 being able to rotate within the housing 122. The first, second and third plates 124, 126, 130 are each arranged to be generally vertically aligned in use.

In this example, the second round plate 126 is fixed to the first upper section 116 and the first fixed plate 124 which locates and carries the pin 146 is fixed to the second lower section 120, although this arrangement could be reversed similarly to the first example. There is also wear plate 133 located between the housing 122 and the first plate 124. It is again noted that in some examples, the wear plate 133 may form part of the housing 122 or could be omitted.

In this example, the first or upper section 116 of the pole 112 includes an elbow 117 and a straight section 119. The elbow 117 providing a 90-degree transition between the second round plate 126 and the straight section 119 that is generally vertically arranged in use. A horizontal connector 129 may be fitted between the elbow 117 and the second plate 126.

Similarly, the second or lower section 120 of the post 112 includes an elbow 121 and a straight section 123. The elbow 121 providing a 90-degree transition between the first fixed plate 124 and the straight section 123 that is generally vertically arranged in use.

Figure 14:
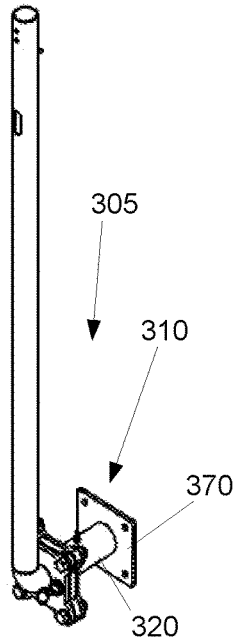
FIG. 14 is a perspective view illustrating a fourth example of the pole assembly and swing arrangement.

It is noted that the type, length and angle of the elbows 117, 121 may be varied to suit particular installation situations. For example, the elbow 121 may be omitted if the second lower section 120 of the post 112 is horizontally arranged such as is shown in FIG. 14.

Like the first example, the housing 122 provides a spacer 132 between the first plate 124 and the third plate 130. The housing 122 includes an aperture 134 with a recess 137 shaped to receive the second plate 126 and retain the second plate 126 therein in the coupled condition. The housing 122 and the wear plate 133 may be formed of a low friction material such as a plastic, more specifically Teflon or Nylon, that allows movement of the second plate 126 therein that may be formed from a metal.

The second plate 126 is generally flat and circular and is received within the recess 137 in the coupled condition. The second plate 126 may be formed of a metal or other suitable material. The second plate 126 is received within the recess 137 and may rotate therewithin. The recess 137 includes a retainer 136 in the form of a skirting lip or annular ledge 138 that captures the second plate 126 within the recess 137 when secured to the first plate 124.

In this arrangement, the second plate 126 is substantially encapsulated by the housing 122 and retained toward the first plate 126. The ledge 138 provides a gap 139, shown in FIG. 7*a*, between the second plate 126 and the third plate 128 so that the third plate 130 bears on the housing 122 and not directly on the second plate 126.

The depth of the recess 137 may be about the same or slightly greater than a thickness of the second plate 126 so that the second plate 126 may be snuggly received, with some friction between the second plate 126, the wear plate 133 and the first plate 124. This allows the second plate 126 to be moved, albeit under some friction, within the housing 122 when the fasteners 140 are tightened. The wear plate 133 is fitted across the open side of the aperture 134 so as to contact the second plate 126. The depth of the recess 137 being defined between a face 135 of the housing 122 and the ledge 138.

As such, it is noted that the fasteners 140 do not need to be released to move the first plate 124 relative to the second plate 126. Therefore, the fasteners 140 do not need to be adjusted in use and may be simply set to a specified tension at which they may remain.

Similarly to the first example, to releasably lock movement of the first plate 124 and the second plate 126, and the respective first and second sections 116, 120 of the pole 112, the swing arrangement 110 includes a hand operable locking part 144 adapted to allow selective movement of the first and second plates 124, 126 in an unlocked state and substantially immobilise movement of the first and second plates 124, 126 in a locked state.

In this example, the locking part 144 includes a pin 146 that is carried by a pin aperture 148 of the first plate 124. The second plate 126 includes several receiving apertures 150 in which the pin 146 is received in the locked state. It is noted that in this example, a plurality of equidistance apertures are provided for adjustability.

The pin 146 is biased using a spring (not shown) into the locked state thereby providing a safety advantage whereby, for example, if the pin 146 is moved to disengage with the apertures 150 of the second plate 126 and then released—the pin 146 will move to automatically return to the locked state thereby, for example, keeping the first section 116 of the pole 112 from falling.

Referring now to FIGS. 12*a* to 16*b*, further examples of the pole assembly 205, 305, 405, 505 are shown in which like sequences of numerals denote like parts. In these examples, the arrangement of the swing arrangements 210, 310, 410 and 510 are the same as those described above in detail in relation to the first and second examples. However, variations of the poles and connections to a wall or supporting structure have been made.

Figure 13:
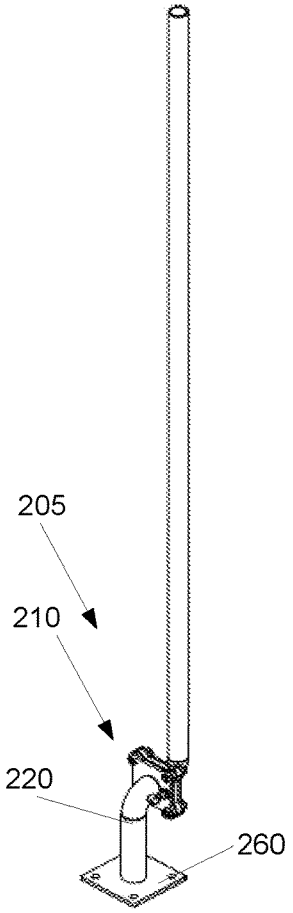
FIG. 13 is a perspective view illustrating a third example of the pole assembly and swing arrangement.
Figure 15:
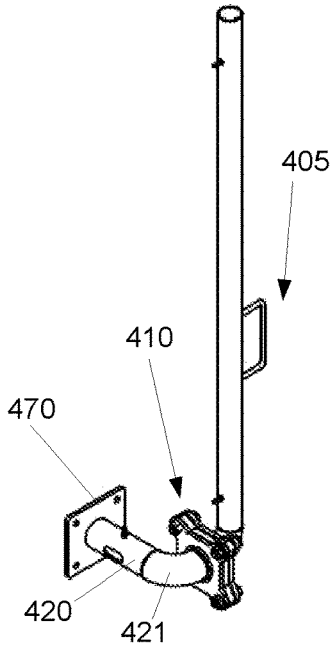
FIG. 15 is a perspective view illustrating a fifth example of the pole assembly and swing arrangement.

In FIG. 13, the pole assembly 205 includes a shorter second section 220 that is connected to a floor plate 260. FIG. 14 provides an example of the pole assembly 305 in which the second section 320 is horizontally arranged to connect to a wall plate 370, and FIG. 15 is a similar arrangement, albeit having an elbow 421 between the second section 420 and the wall plate 470.

FIGS. 16*a* to 17*b* show a further example in which the swing arrangement 510 connects directly to a second section 520 that has a generally square cross section with a housing 580 therein and a floor plate 560. In this example, the first plate 524 has a square block shape and is fixed to the second section 520. The second plate 526 is connected to the first section 516 and a third part 528 in the form of the third plate 530 is secured to the first plate 524 via the wear plate 533 and housing 522. The pin 546 may be actuated to release the second plate 526 to allow rotation thereof, and thereby allowing the first section 516 to be relatively lowered and raised. An elbow 517 provides a 90-degree transition between the second plate 526 and the first section 516. A horizontal connector 529 may be fitted between the elbow 517 and the second plate 526

Advantageously, there have been described examples of the swing arrangement with a housing and a locking pin that allows for a coupling between, for example, upper and lower sections of a pole so that the upper section of the pole may be safely and easily raised and lowered. In particular, the arrangement including a low friction material of the housing and/or wear plates provides some predetermined frictional resistance, but allows movement, of the upper section of the pole upon moving the locking pin between the locked and unlocked states. The friction of the housing and/or wear plates slowing rapid movement or falling the upper section of the pole, and the removing the need to use tools to, for example, regularly tighten and loosen fasteners to increase or decrease any clamping related friction. The friction resistance also partly supporting the weight of the upper section. The locking pin also being biased to the lock state so as to automatically lock if, for example, the operator was to slip and drop the upper section of the pole and release the pin.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any known matter or any prior publication is not, and should not be taken to be, an acknowledgment or admission or suggestion that the known matter or prior art publication forms part of the common general knowledge in the field to which this specification relates.

While specific examples of the invention have been described, it will be understood that the invention extends to alternative combinations of the features disclosed or evident from the disclosure provided herein.

Many and various modifications will be apparent to those skilled in the art without departing from the scope of the invention disclosed or evident from the disclosure provided herein.

The claims defining the invention are as follows:

1. A swing arrangement for a pole to provide a rotational axis about which a first and a second section of the pole are pivotally moveable, the swing arrangement including a first plate associated with a first section of the pole, a second plate associated with a second section of the pole, a housing with an aperture arranged to rotatably house the second plate and a third plate adapted to be coupled to the first plate with the housing clamped therebetween in a coupled condition with the housing providing a spacer between the first plate and the third plate, wherein the housing includes a friction reducing material and a retainer adapted to capture the second plate within the aperture such that in the coupled condition a predetermined clamping force is applied to the second plate so as provide friction constrained rotation about the rotational axis, wherein the swing arrangement includes a hand operable locking part adapted to allow selective movement of the first and second plates in an unlocked state, and substantially immobilise movement of the first and second plates in a locked state and the hand operable locking part is biased toward the locked state.

2. The swing arrangement according to claim 1, wherein the retainer is a ledge at least partially blinding the aperture.

3. The swing arrangement according to claim 2, wherein the housing includes a recess defined between a face of the housing and the ledge, and wherein the depth of the recess is substantially equal to a thickness of the second plate.

4. The swing arrangement according to claim 3, wherein the recess is shaped to snugly fit with the second plate.

5. The swing arrangement according to claim 1, wherein the housing is formed of or includes a friction reducing plastic.

6. The swing arrangement according to claim 1, wherein the first plate, the third plate and the housing are clamped together by one or more fasteners to inhibit relative rotation thereof.

7. The swing arrangement according to claim 1, wherein the second plate is circular and the aperture is also circular so as to allow rotation of the second plate therewithin.

8. The swing arrangement according to claim 1, wherein the hand operable locking part is carried by and accessible from the first plate.

9. The swing arrangement according to claim 1, wherein the second plate includes at least one aperture to receive the hand operatable locking part in the locked state.

10. The swing arrangement according to claim 1, wherein the friction reducing material is a plastic.

11. The swing arrangement according to claim 1, wherein the rotational axis is at an acute angle relative to the first section of the pole.

12. The swing arrangement according to claim 1, wherein the rotational axis is at a horizontal angle relative to the first section of the pole.

13. The swing arrangement according to claim 1, wherein a wear plate is located between the housing and the first plate.

14. The swing arrangement according to claim 1, wherein the first plate is connected to the first section of the pole, and wherein the second plate is connected to the second section of the pole.

15. A pole assembly including a swing arrangement according to claim 1.

16. A swing arrangement for a pole to provide a rotational axis about which a first and a second section of the pole are pivotally moveable, the swing arrangement including a first part connected to a first section of the pole, a second part connected to a second section of the pole, a housing with an aperture arranged to rotatably house the second part and a third part adapted to be coupled to the first part with the housing clamped therebetween in a coupled condition with the housing providing a spacer between the first part and the third part, wherein the housing includes a friction reducing material and a retainer adapted to capture the second part within the aperture such that in the coupled condition a clamping force is applied to the second part so as provide friction constrained rotation about the rotational axis, wherein the swing arrangement includes a hand operable locking part adapted to allow selective movement of the first and second parts in an unlocked state, and substantially immobilise movement of the first and second parts in a locked state and the hand operable locking part is biased toward the locked state.

* * * * *